US009175229B2

(12) United States Patent
Baumgartner et al.

(10) Patent No.: US 9,175,229 B2
(45) Date of Patent: Nov. 3, 2015

(54) METHOD AND APPARATUS FOR QUENCHING A HOT GASEOUS STREAM

(75) Inventors: Arthur James Baumgartner, Houston, TX (US); A. Haluk Bilgic, Houston, TX (US); Danny Yuk Kwan Ngan, Houston, TX (US)

(73) Assignee: Shell Oil Company, Houston, TX (US)

( * ) Notice: Subject to any disclaimer, the term of this patent is extended or adjusted under 35 U.S.C. 154(b) by 542 days.

(21) Appl. No.: 13/574,810

(22) PCT Filed: Jan. 25, 2011

(86) PCT No.: PCT/US2011/022309

§ 371 (c)(1),
(2), (4) Date: Sep. 10, 2012

(87) PCT Pub. No.: WO2011/094169

PCT Pub. Date: Aug. 4, 2011

(65) Prior Publication Data

US 2013/0001132 A1 Jan. 3, 2013

Related U.S. Application Data

(60) Provisional application No. 61/298,290, filed on Jan. 26, 2010.

(51) Int. Cl.
*C10G 9/00* (2006.01)

(52) U.S. Cl.
CPC ..... *C10G 9/002* (2013.01); *C10G 2300/1022* (2013.01); *C10G 2300/1059* (2013.01); *C10G 2400/20* (2013.01)

(58) Field of Classification Search
CPC ..... C10G 9/002; C10G 2300/1022; C10G 2300/1059; C10G 2400/20
See application file for complete search history.

(56) References Cited

U.S. PATENT DOCUMENTS

| | | | | |
|---|---|---|---|---|
| 2,951,029 | A | 8/1960 | Johnston et al. | 208/100 |
| 4,279,733 | A | 7/1981 | Gwyn | 208/48 |
| 4,279,734 | A | 7/1981 | Gwyn | 208/48 |
| 4,446,003 | A | 5/1984 | Burton et al. | 208/48 |
| 4,614,229 | A * | 9/1986 | Oldweiler | 165/115 |
| 5,092,981 | A * | 3/1992 | Russo | 208/48 Q |
| 5,185,077 | A | 2/1993 | Owen | 208/61 |
| 5,324,486 | A * | 6/1994 | Russo | 422/207 |
| 6,019,818 | A | 2/2000 | Knapp | 95/187 |
| 6,626,424 | B2 | 9/2003 | Ngan et al. | 261/112.1 |
| 6,821,411 | B2 | 11/2004 | Baca et al. | 208/130 |
| 2007/0007173 | A1 * | 1/2007 | Strack et al. | 208/106 |

(Continued)

FOREIGN PATENT DOCUMENTS

NL EP 0205205 * 12/1986

*Primary Examiner* — Randy Boyer
*Assistant Examiner* — Juan Valencia

(57) ABSTRACT

The invention comprises a process for cracking liquid hydrocarbon feed to produce cracked gaseous hydrocarbons comprising feeding a liquid hydrocarbon feed stream to an olefins furnace; cracking the liquid hydrocarbon feed stream in the olefins furnace to produce a gaseous cracked effluent stream; feeding the cracked effluent from the olefins furnace to a primary transfer line heat exchanger (TLE) having two sections; injecting a first wetting fluid in a weight ratio of wetting fluid to hot gaseous effluent tangentially into the hot gaseous effluent stream at a particular location in the second section of the primary TLE; feeding the hot gaseous effluent stream exiting from the TLE to a separator; separating a separator bottoms stream comprising tar and heavier hydrocarbons and a separator product stream comprising an olefin product; and recovering an olefin product from the separator product stream.

9 Claims, 4 Drawing Sheets

(56) References Cited

U.S. PATENT DOCUMENTS

2008/0128323 A1 6/2008 McCoy et al. ..... 208/44
2008/0128326 A1 6/2008 McCoy et al. ..... 208/69
2008/0128330 A1 6/2008 McCoy et al. ..... 208/48
2009/0280042 A1 11/2009 McCoy et al. ..... 422/189

* cited by examiner

METHOD AND APPARATUS FOR QUENCHING A HOT GASEOUS STREAM

PRIORITY CLAIM

The present application claims priority from PCT/US2011/022309, filed 25 Jan. 2011, which claims priority from U.S. provisional 61/298,290, filed 26 Jan. 2010.

FIELD OF THE INVENTION

The invention is generally directed to methods and apparatus for quenching a hot gaseous stream in an olefins plant. The invention is more specifically directed to methods and apparatus for quenching the pyrolysis product from a pyrolysis furnace used in an olefins plant.

DESCRIPTION OF RELATED ART

After the feeds are thermally cracked in a pyrolysis furnace, the pyrolysis products exiting the radiant tube section of the furnace at ~1400-1650° F. have to be cooled (or quenched) to ~1200° F. rapidly to stop the reaction. For lighter feeds, the quenching is usually done by passing the furnace product effluents through a Transfer Line Exchanger ("TLE"), which is a shell-and-tube heat exchanger where the process gas is cooled inside the tubes while the shell side coolant is boiler feed water at ~600° F., generating saturated steam as it is heated by the hot process gaseous products. Coke will form on the inside wall of the TLE tubes, reducing heat transfer, and lead to pressure drop across the TLE and increasing TLE outlet temperature. This will eventually require cleaning out the coke, which will require stopping the feed to the furnace to perform steam/air decoking or mechanical decoking. For very heavy feeds and/or feeds with low hydrogen content, the coking rate in the TLE is much higher—making frequent TLE decoking impractical. One option is to use direct quench, which is accomplished by directing product effluent from the furnace into quench tubes and injecting quench oil directly into the quench tubes to cool the product effluents from the radiant tubes of the furnace. See, e.g. US Published Patent Applications 2008/0128323; 2008/0128326; and 2008/0128330 which disclose direct quenching. The quench oil needs to be injected in such a way that it keeps the inner wall of the quench tube completely irrigated. Otherwise, coke will start forming on any dry spot along the quench tube wall, eventually leading to coke build-up. The use of direct quench has the disadvantage of not generating as much higher valued high pressure steam as that which could be generated by the TLE. Many solutions to the problem have been disclosed in the past. See, e.g., the following patents relating to the use of quench and TLEs including U.S. Pat. Nos. 2,951,029; 4,279,733; 4,279,734; 4,446,003; 4,614,229; 5,092,981; 5,185,077; 5,324,486; 6,626,424; and 6,821,411. However, there are still significant problems with the quench processes as disclosed in the above patents and published patent applications, including short run times due to fouling, and the loss of valuable heat that could otherwise be recovered as superheated steam. What is needed is an improved process that will allow maximum generation of superheated steam along with much reduced fouling, while maintaining long TLE run-length.

SUMMARY OF THE INVENTION

The present invention relates to a novel and innovative process and apparatus for producing olefins in a pyrolysis furnace employing TLEs to cool the pyrolysis gases. The invention involves injecting a "minimal" amount of wetting fluid into the tubes of TLEs—just having enough wetting fluid to keep the tube wall wetted thus to prevent coking, but not enough to substantially cool the effluent—wherein the wetted-wall TLE can generate high pressure steam as well as have long run-lengths. Another aspect of the present invention is how to properly introduce this proper amount of wetting oil into the portion of the TLE where pyrolysis tar can condense and foul the heat exchanger. One aspect of the claimed invention includes the use of a tangential oil injection nozzle along with a tube-in-tube heat exchanger (TLE) such as an Omega USX, (sold by Shaw Group). Another aspect of the present invention is that the operational range of the cooling/quenching is increased to include not only preventing or minimizing the fouling of TLEs by condensation of tars from pyrolysis of very heavy feedstocks but also to minimizing the fouling of lower temperature secondary TLEs, (downstream of the primary TLEs). Accordingly, a less viscous, lower boiling wetting oil is used in the secondary TLE whereby heat is recovered by much lower temperature secondary TLEs. Currently, secondary TLEs are not normally used for recovering heat from pyrolysis gases created by cracking of liquid feedstocks, (hydrocarbon feedstocks covering the boiling point range from gasoline to vacuum gas oil or VGO) because even the small amount of tars produced by pyrolysis of a low tar producing feedstock such as gasoline would rapidly foul relatively low temperature secondary TLEs. Hence minimum design TLE outlet temperatures for light liquids are limited to roughly 600° F. and only primary TLEs are used currently. While at the present time secondary TLEs are only applied to recover heat from ethane or propane pyrolysis gas (since pyrolysis of those gases produce such a small amount of tar that heat from their furnace effluent can be recovered down to ~250-300° F. without tar condensation), in the presently claimed process and apparatus we are able to use such secondary TLEs because we are better able to control fouling at low temperatures when cracking heavy liquid feed streams. By injecting a wetting oil in secondary TLEs we are able to recover heat down to the limiting temperature required for reboiling of the downstream fractionator—or about 400° F.

What is claimed is a process for cracking liquid hydrocarbon feed to produce cracked gaseous hydrocarbons, the process comprising the steps of:

(a) feeding a liquid hydrocarbon feed stream to an olefins furnace;

(b) cracking the liquid hydrocarbon feed stream in the olefins furnace to produce a hot gaseous cracked effluent stream having a temperature of about 1400 to about 1650° F.;

(c) feeding the hot gaseous cracked effluent stream from the olefins furnace to the first section of a primary transfer line heat exchanger (TLE), which first section of said primary TLE comprises a shell-and-tube heat exchanger where the hot gaseous cracked effluent stream is indirectly cooled on the tube side while generating high-pressure steam from boiler feed water on the shell side [In the simplest form, the shell side is comprised of an outer tube enclosing an inner tube to form an annulus through which the steam and water mixture flow with the inner tube containing the hot gaseous cracked effluent. The first section may also be of a shell and multiple tube construction where the hot gaseous cracked effluent flows through the many parallel tubes that are enclosed by a single shell—in which high-pressure steam is generated. It may also be a steam superheater where high-pressure steam generated by the second portion of the primary TLE, (described below) is superheated on the shell side with hot gaseous cracked effluent flowing through the tube side];

(d) feeding the gaseous cracked effluent exiting the first section of the primary TLE to the tube side of a second section of the primary TLE, where a flow obstruction means is positioned in said tube side of the second section to create a low-pressure zone in said gaseous cracked effluent stream immediately downstream of said flow obstruction means, and where the gaseous cracked effluent stream is indirectly cooled on the tube side while generating saturated steam from boiler feed water on the shell side;

(e) injecting a wetting fluid tangentially into said gaseous cracked effluent stream at said low-pressure zone at a momentum sufficient to cause said wetting fluid to flow circumferentially around the inside surface of said tube side; providing a sharp interface between said gaseous cracked effluent stream and said first wetting fluid; and causing said first wetting fluid to contact and wet the downstream face of said flow obstruction means;

(f) wherein the weight ratio of wetting fluid to the hot gaseous feed stream entering the tube side of a second section of the primary TLE is about 0.5 to about 2.0 [the typical wetting fluid for the primary TLE is primarily composed of pyrolysis pitch];

(g) wherein the exit temperature of said gaseous effluent stream from the first section of said primary TLE is between about 1100° F. and about 1200° F. and the exit temperature of the second section of the primary TLE is approximately 50° F. above the temperature of the saturated steam being generated;

(h) feeding the gaseous cracked effluent stream exiting from the second section of said primary TLE to a separator;

(i) removing in the separator, a separator bottoms liquid stream comprising tar and heavier hydrocarbons and a separator product gas stream comprising an olefin rich product; and optionally (j) recovering olefin product(s) from the separator product gas stream.

Injection of a wetting fluid into a TLE performs a similar wetting function to that required by quench oil in a direct quench furnace where specially designed quench nozzles are used to introduce quench oil into quench tubes where it is combined with furnace effluent. However, the weight ratio of wetting fluid to feed in the present invention is about 0.5 to about 2, preferably 0.5 to 1, compared to over a 5 to 1 ratio in the typical direct quench operation and the wetting fluid is much less volatile than quench oil. These differences result from quench oil in direct quench furnaces not only being used to wet the entire internal surface of the quench tube and thereby prevent coke deposition but also being used to substantially cool the hot gaseous pyrolysis products coming out of the radiant tubes in a pyrolysis furnace by partial vaporization of the quench oil. In the present invention the primary purpose of the wetting fluid is only to prevent coke deposition in the TLE. In a direct quench furnace, the quench tube walls are maintained wetted by the use of an internal ring with a specially-tapered leading edge and an abrupt terminal end which serves to prevent the quench oil/gas interface from moving axially back and forth in the quench tube, and thereby eliminating coke formation. A similar design is employed for introducing the wetting oil into TLE tubes to prevent fouling as described herein.

Another aspect of the present invention includes the optional use of a secondary TLE. In this aspect the process comprises:

(a) feeding a liquid hydrocarbon feed stream to an olefins furnace;

(b) cracking the liquid hydrocarbon feed stream in the olefins furnace to produce a hot gaseous cracked effluent stream having a temperature of about 1400 to about 1650° F.;

(c) feeding the hot gaseous cracked effluent stream from the olefins furnace to the first section of a primary transfer line heat exchanger (TLE), which first section of said primary TLE comprises a shell-and-tube heat exchanger where the hot gaseous cracked effluent stream is indirectly cooled on the tube side while generating high-pressure steam from boiler feed water on the shell side;

(d) feeding the gaseous cracked effluent exiting the first section of the primary TLE to the tube side of a second section of the primary TLE, where a flow obstruction means is positioned in said tube side of the second section to create a low-pressure zone in said gaseous cracked effluent stream immediately downstream of said flow obstruction means, and where the gaseous cracked effluent stream is indirectly cooled on the tube side while generating saturated steam from boiler feed water on the shell side;

(e) injecting a first wetting fluid tangentially into said gaseous cracked effluent stream at said low-pressure zone at a momentum sufficient to cause said wetting fluid to flow circumferentially around the inside surface of said tube side; providing a sharp interface between said gaseous cracked effluent stream and said first wetting fluid; and causing said first wetting fluid to contact and wet the downstream face of said flow obstruction means; and wherein the weight ratio of wetting fluid to the hot gaseous feed stream entering the tube side of a second section of the primary TLE is about 0.5 to about 2.0 and wherein the exit temperature of said gaseous effluent stream from the first section of said primary TLE is between about 1100° F. and about 1200° F. and the exit temperature of the second section of the primary TLE is approximately 50° F. above the temperature of the saturated steam being generated;

(f) feeding the gaseous cracked effluent stream exiting from the second section of said primary TLE to a separator;

(g) removing in the separator, a separator bottoms liquid stream comprising tar and heavier hydrocarbons and a separator product gas stream comprising an olefin rich product;

(h) feeding the separator product gas stream exiting the separator to a secondary TLE where the separator product gas stream is indirectly cooled on the tube side to an exit temperature of between about 400 to about 500° F. while generating low-pressure steam on the shell side from boiler feed water and where a second flow obstruction means is positioned in said tube side of said secondary TLE to create a low-pressure zone in said product gas stream immediately downstream of said second flow obstruction means whereby a second wetting fluid is introduced at said low-pressure zone at sufficient flowrate to maintain the downstream internal surfaces in a wetted state;

(i) feeding the gaseous cracked effluent stream exiting from said second TLE to a second separator;

(j) removing from the second separator, a separator liquid bottoms stream comprising tar and heavier hydrocarbons and a separator product gas stream comprising an olefin rich product; and optionally (k) recovering olefin product(s) from the separator product stream.

As for the separators, they are typically separate vessels. The first fractionator downstream of the furnaces, herein called the pyrolysis fractionator could also be used in place of a separator so that the tar concentration in the wetting fluid, (essentially pitch recycle) would not be allowed to build up too much, the pyrolysis pitch product from the pyrolysis fractionator acting as a purge.

The present invention has many advantages, including:

More heat recovery as High Pressure (HP) steam. Currently a large amount of heat is lost as a result of direct quenching of the gas leaving a TLE in the typical TLE with high end of run temperatures.

The claimed process can be designed to be self-sufficient, generating a large amount of HP steam to drive downstream compressors required for separation and purification of light olefins and not requiring additional heat removal in the pyrolysis fractionator.

The claimed process can be designed for existing TLE furnaces and will not necessarily require a superheater in the convection section of the furnace, allowing for more heating of the feed before it enters the radiant tube section of the furnace. This additional heat can be used for either higher feed rate or higher end-point feed vaporization.

The claimed process results in a relatively non-fouling TLE, needing only very occasional decoking; minimizing downtime for TLE mechanical cleaning.

The claimed process can crack heavier feeds in existing naphtha furnaces, which can have a significant financial incentive. Heavy feeds (VGO and condensate) with low hydrogen content when cracked in naphtha cracking furnaces equipped with an existing TLE would experience unacceptably short TLE run-length due to rapid coking in the TLE. The wetted-wall TLE would provide a non-coking surface in the TLE tubes that allows these heavier feeds to be cracked at high severity; and more importantly allows about the same heat recovery as high pressure steam in the wetted-wall TLE as in a TLE without such wetting. In the proposed configuration with superheating of steam in the first portion of the primary TLE, changes in the steam balance of the plant and modifications required of the heat removal capacity in the pyrolysis fractionator are minimized, making it feasible to convert a naphtha cracker plant to process heavier gas oil or condensate.

DESCRIPTION OF THE PREFERRED EMBODIMENTS

The heavy hydrocarbon feed may comprise a range of heavy hydrocarbons. Examples of suitable feedstocks include, but are not limited to, one or more of heavy hydrocarbon streams from refinery processes, vacuum gas oils, heavy gas oil, and other heavy crude oil fractions. Other examples include, but are not limited to, high end point condensates, deasphalted oil, oils derived from tar sands, oil shale and coal, and synthetic hydrocarbons such as SMDS (Shell Middle Distillate Synthesis) heavy ends, GTL (Gas to Liquid) heavy ends, Heavy Paraffins Synthesis products, Fischer Tropsch products and hydrocrackate.

The first wetting fluid used in the primary TLE includes thermally stable oils, including heavy very low vapor pressure oils. Preferred wetting fluids for the primary TLE are pyrolysis pitch and similar oils originating in the lower portion of the pyrolysis fractionator which cannot be substantially vaporized at the TLE tube temperature where it is injected. The second wetting fluid used in the secondary TLE includes gas oils such as those typically produced from the pyrolysis fractionator.

As for the relative amount of wetting fluids used, it is important that one inject a minimal amount of wetting fluid into the tube of the primary TLE—just having enough wetting fluid to keep the tube wall wetted thus to prevent coking, but not enough to substantially cool the effluent—wherein the wetted-wall TLE can be generating high pressure steam as well as having long run-lengths. The wetting fluid can be provided by blending streams from the pyrolysis fractionator. For example, the heavier first wetting fluid can be prepared by mixing the bottom pitch with cracked heavy gas oil ("CHGO"), both streams from the pyrofrac. The lighter second wetting fluid can be prepared from mixing CHGO with cracked light gas oil ("CLGO") from the pyrofrac. The relative amounts of each component can be varied so that the resulting wetting fluid has the proper boiling range, API gravity and viscosity.

Figure 1:
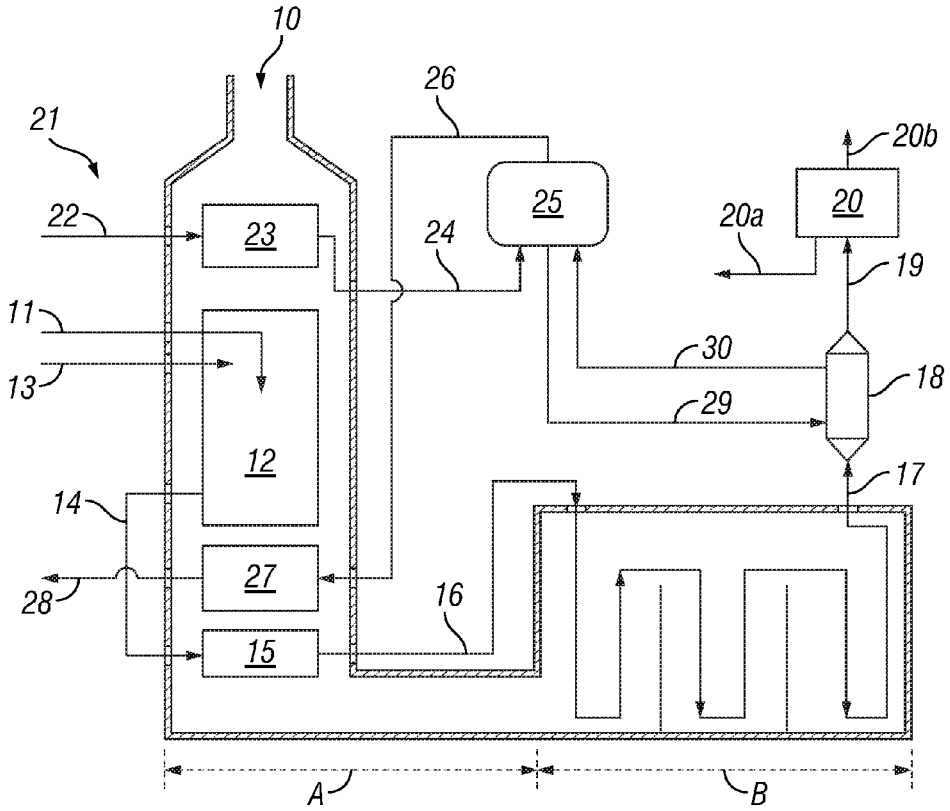
FIG. 1 is a schematic drawing showing the overall process, including a primary TLE.

The invention is described below while referring to FIG. 1 as an illustration of the invention. It is to be understood that the scope of the invention may include any number and types of process steps between each described process step or between a described source and destination within a process step. The olefins pyrolysis furnace 10 is fed with a heavy hydrocarbon 11 entering into the first stage preheater 12 of a convection zone A.

The first stage preheater (feed preheater coil) 12 in the convection section is typically a bank of tubes, wherein the contents in the tubes are heated primarily by convective heat transfer from the combustion gas exiting from the radiant section of the pyrolysis furnace. In one embodiment, as the heavy hydrocarbon feedstock travels through the first stage preheater 12, it is heated to a temperature which promotes complete evaporation of the feedstock The pressure within the first stage preheater 12 is not particularly limited. The pressure within the first stage preheater is generally within a range of 50 psig-400 psig, more preferably from about 60-180 psig.

To assist in the vaporization of liquid feedstocks in the convection section of the furnace, a dilution gas 13 is fed to the furnace, most commonly to one or more portions of the feedstock heating and vaporization zones incorporated into the convection section of a pyrolysis furnace after some preheating of the feed has occurred.

The heated steam/gas mixture exits the first feed preheater 12 via line 14 and is then fed to the second stage preheater 15 and is heated in the second stage preheater as it flows through tubes heated by combustion gases from the radiant section of the furnace. In the second stage preheater 15, the superheated steam-gas mixture is fully preheated to near or just below a temperature at which significant feedstock cracking and associated coke deposition in the preheater would occur. The mixed feed subsequently flows to the radiant section B through line 16 of the olefins pyrolysis furnace where the gaseous hydrocarbons are pyrolyzed to olefins and associated by-products exiting the furnace through line 17. Products of an olefins pyrolysis furnace include, but are not limited to, ethylene, propylene, butadiene, benzene, hydrogen, and methane, and other associated olefinic, paraffinic, and aromatic products. Ethylene is the predominant product, typically ranging from 15 to 30 wt %, of the feedstock. A small amount of pyrolysis tar is also produced, its quantity increasing with heavier feedstocks such as gas oils especially when pyrolyzed at high severity so as to produce maximum ethylene yield.

Pyrolytic cracking furnace 10 defines a pyrolytic cracking zone (the radiant section of the furnace) and provides means for pyrolytically cracking the feedstock to thereby yield a product rich in lower molecular weight olefins such as ethylene, propylene and butadiene. The lower olefin-rich product passes from pyrolytic cracking furnace 10 through conduit 17. As stated above, the pyrolytic cracking product comprises lower olefins but includes other derivatives.

Then the cracked effluent exiting the radiant section of the olefins furnace at line 17 is fed to a first (primary) transfer line heat exchanger (TLE) 18, which primary TLE comprises a shell-and-tube heat exchanger where the hot gaseous cracked effluent stream is indirectly cooled on the tube side while generating steam on the shell side. It is important that the cracked effluent be cooled quickly to a temperature of less than 1200° F., in order to stop the cracking and reduce fouling and coke formation. The gaseous effluent stream exiting the TLE is then routed via line 19 to a separator 20. In the separator 20 a bottoms product 20*a* pyrolysis pitch comprising tar and heavy hydrocarbons is separated from lighter components 20*b* The separator may comprise a pyrolysis oil fractionator or another vessel and streams produced by it via further separation of 20*b* might then include the bottoms containing traces of tar and the heaviest hydrocarbons, side streams such as heavy gas oil and light gas oil and a top mixed gasoline and olefins product.

Regarding the steam generation in the furnace and TLE, boiler feed water (BFW) 21 is fed via line 22 to the boiler feed preheater 23 located in the olefins furnace. BFW at a temperature of about 525° F. is then routed via line 24 to a high pressure (about 1320 psig) steam drum 25. In the steam drum high pressure (HP) steam is removed via line 26 where it is routed to a steam superheater 27 in the olefins furnace where it is heated from about 580° F. to about 1055° F. This superheated steam 28 is typically supplied to steam turbines that are used to drive gas compressors required for compression and cryogenic separation of lower olefins produced by an ethylene plant.

Figure 2:
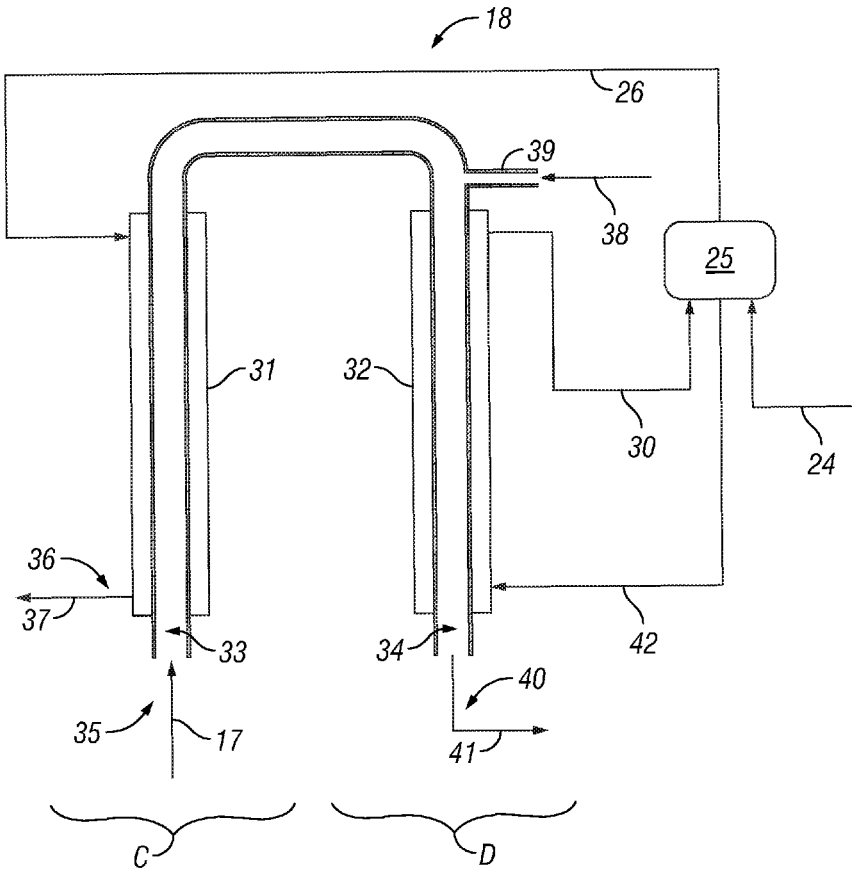
FIG. 2 is the wetted-wall configuration of the primary TLE.

The following arrangement description refers to an embodiment where steam produced in the second part of the primary TLE is superheated in the first part of the primary TLE. The saturated steam from the steam drum is then withdrawn from the steam drum via line 26 and routed to the first section of the primary TLE 18 as shown further in FIG. 2. The saturated steam generated in the second portion of the primary TLE is then routed back to the steam drum 25 via line 30. Line 30 will also contain a large amount of the saturated water along with the saturated steam. The steam drum 25 is positioned well above the TLE so liquid water is supplied to the TLE. The formation of steam in the TLE causes a large thermosiphon effect to occur, (the steam being much lighter than water, it rises to the steam drum) inducing a large recirculation of water.

Referring again to FIG. 2, this shows schematically what comprises the primary TLE 18. The primary TLE is a shell and tube heat exchanger, where the shell sides 31 and 32 are for the coolant and the tube sides 33 and 34 are for the hot gaseous cracked effluent. There are two sections—a first section C and a second section D. In the first section C, radiant coil gaseous cracked effluent 35 is routed via line 17 to the inner tube 33 where the gaseous effluent is cooled from a temperature of about 1400 to about 1650° F. to a temperature of between about 1000 and about 1300° F. by cooling from saturated steam 26 from the steam drum 25. The superheated steam 36 exits via line 37 and may be used or routed to a steam superheater in the olefins furnace (see 27 in FIG. 1).

In the second section D, partially cooled gaseous cracked effluent from the first section C is routed to the inner tube 34 where the gaseous effluent is cooled from a temperature of about 1000 to about 1300° F. to a temperature of about 700 to about 750° F. by cooling from partial vaporization of BFW 42 from the steam drum 25. Make-up BFW is added via line 24. The saturated steam and water mixture exits via line 30 to the steam drum 25. Wetting oil 38 is injected into the second stage via a tangential nozzle 39 to assure that the walls of the second section tube are wetted and to eliminate coking on the tubes. The location of the injection nozzle is important. It should be located a minimum of 5 pipe diameters and preferably about 10 pipe diameters downstream of any elbows to ensure uniform quench oil flow through the nozzle. The cooled effluent 40 is either routed to a separator or if a secondary TLE is used, the vapor from the separator is routed to that secondary TLE, via line 41.

Figure 3:
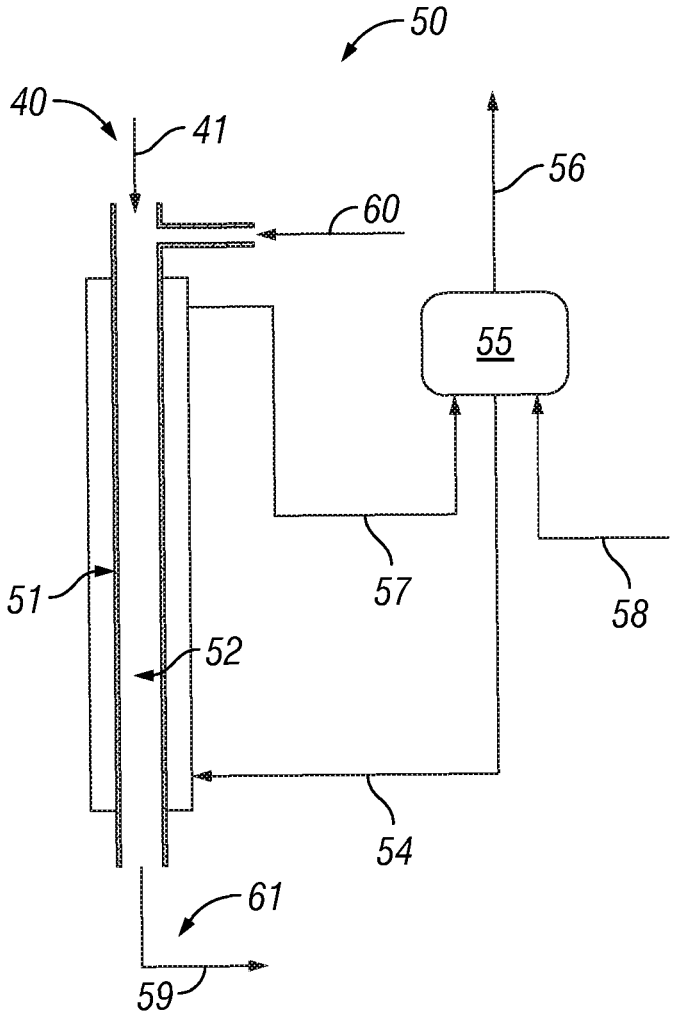
FIG. 3 is the wetted-wall configuration of the secondary TLE.

Referring now to FIG. 3, this shows schematically what comprises the secondary TLE 50. The secondary TLE is a shell and tube heat exchanger, where the shell side 51 is for the coolant and the tube side 52 is for the hot gaseous cracked effluent 40 exiting via line 41 from the separator downstream of the primary TLE 18. A wetting fluid is added at line 60. There is only one section in the secondary TLE as compared with two sections in the primary TLE, since it is necessary that the entire wall of the secondary TLE be wetted to stop coke formation in view of the lower temperature in the secondary TLE. In the secondary TLE 50, gaseous cracked effluent 40 exiting from the primary TLE is routed to the inner tube 52 where the gaseous effluent is cooled by a cooling medium such as BFW, 54 from a (lower pressure, 175-200 psig) steam drum 55. Other cooling mediums such as those commonly used in secondary TLEs could also be used. For instance the cooling medium could be instead feed to the furnace (stream 11 of FIG. 1) whereby the secondary TLE would act as a furnace feed preheater.

The low pressure 175 psig steam exits via line 56 and may be used for process heating needs elsewhere in the ethylene plant. A mixture of saturated steam and water, having removed heat from the hot gaseous effluent, exits at line 57 and is routed to the steam drum 55. Make up BFW is added via line 58. The cooled effluent 61 from the secondary TLE 50 is routed via line 59 to a separator (for example, the separator shown in FIG. 1).

Figure 4:
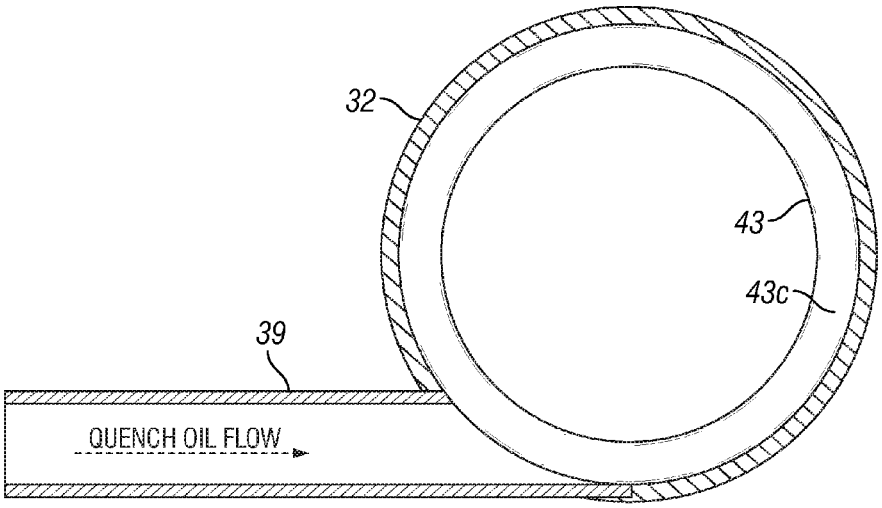
FIG. 4 is a cross section of the quench tube and nozzle of the present invention.
Figure 5:
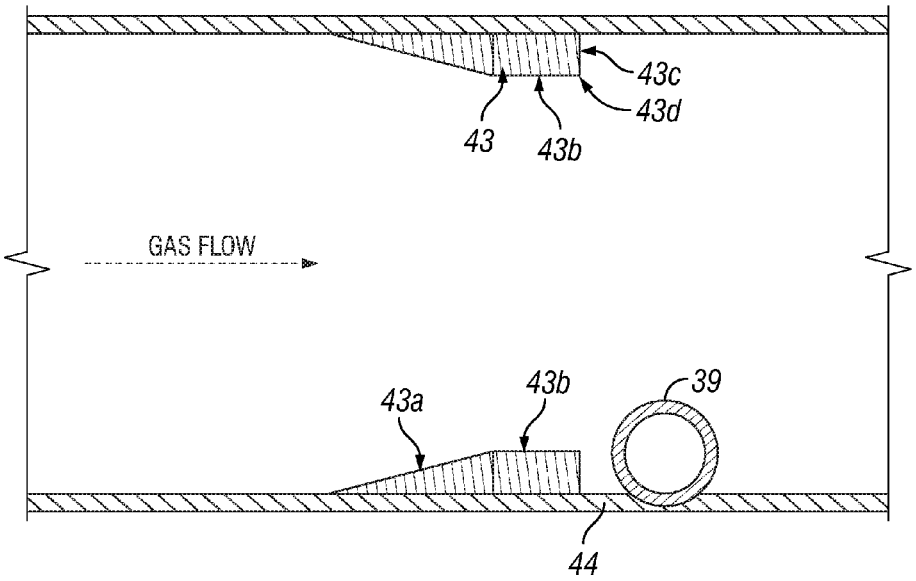
FIG. 5 is a cross section view taken along the longitudinal axis of FIG. 4.

Referring now to FIG. 4, quench tube 32 in the primary TLE is shown in cross section and having a wetting oil inlet tube or nozzle 39 which forms an entry into tube 32 on a tangent thereto. FIG. 4 is taken on a diameter of nozzle 39 and of tube 32 where the two conduits intersect. FIG. 5 shows a cross section of tube 32 taken along the longitudinal axis thereof and looking back into the nozzle 39. Within tube 32 and upstream of nozzle 39 (relative to gas flow) is an insertion ring 43 having a ramp portion 43*a* terminating in a flat section 43*b*, the latter having a sharp interface with face 43*c*. That is, flat section 43*b* and face 43*c* of insertion ring 43 intersect at a right angle to form a sharp edge 43*d*. The function of the insertion ring 43 and variations thereof is to form a low-pressure zone 44 at the downstream face 44*c*.

Nozzle 39, in its simplest form, may be a constant-diameter pipe which enters quench tube 32, preferably at a right angle and with one of its walls on a tangent to the quench tube 32. An insertion ring 43 is located a short distance upstream of nozzle 39 and creates a low-pressure zone 44 at face 43*c*. The optimum distance between face 43*c* and nozzle 39 is the distance that results in no liquid flowing over the sharp edge 43*d* but which completely wets face 43*c*. The wetting fluid injected by nozzle 39 flows circumferentially around the inner surface of quench tube 32 (because of the tangential injection at sufficient pressure) filling the low-pressure zone 44 to the face 43*c*. In order for the invention to function properly, it is necessary that the liquid being injected tangentially through nozzle 39 have sufficient velocity so that the applied centrifugal force acting on this incoming stream for the duration of the fluid's first revolution within quench tube 32 exceeds that acting on the incoming stream which is due to the gravitational field in effect in this region of the apparatus. In other words, this velocity must be such that:

$U^2/(Rg)>1$ where:

$U^2$ is the square of the inlet velocity,

R is the inside radius of tube 32, and g is the acceleration of gravity, all expressed in a consistent set of dimensional units.

Typical values of $U^2/(Rg)$ range between 3 and 20. The wetting fluid is then spread along the inner wall of the tube 32 as a result of fluid drag forces acting on the oil by the gas phase. This interaction between the gas and oil phases also results in some transfer of momentum in the downstream direction from the gas to the wetting fluid. In this manner, face 43*c* and the inner wall of the tube 32 downstream thereof, are maintained in a "wet" condition, thereby creating a two-phase annular flow regime which inhibits the formation of coke. The portion of tube 32 upstream of face 43*c*, including surfaces 43*a* and 43*b* of insertion ring 43, remain "dry" and are, therefore, not subject to coke formation. The sharp edge, 43*d* of insertion ring 43, forms the abrupt interface between "wet" and "dry" sections.

Insertion ring 43 has been described herein as having flat sections (43*a*, 43*b* and 43*c*) but could also be constructed with curved, extended or shortened sections. The critical features required to be maintained are the sharp interface 43*d* and the low-pressure zone 44. FIG. 6 (FIG. 6 is not in the drawings) in U.S. Pat. No. 6,626,424 illustrates one combination for insertion ring 14. FIG. 6 utilizes a concave section 14*c* to contain the low-pressure zone and alter the angle of the sharp edge, 14*d*. Other combinations for the insertion ring can be found in U.S. Pat. No. 6,626,424, which disclosure is herein incorporated by reference.

Although the nozzle 39 is described herein in terms of a tube or conduit (cylindrical) element, it could be of other shapes in cross section, i.e., elliptical, square, rectangular, etc. The critical features of the design are the utilization of a tangential, or approximately tangential, inlet tube to impart a velocity to the oil of sufficient momentum to cause the oil to flow around the circumference of the quench tube 32 while completely wetting the face 43*c*. Likewise, although only one nozzle is described, plural nozzles could be used, e.g., two nozzles diametrically opposed on quench tube 32 so as to aid each other in circumferentially flowing the wetting fluid. Also, the tangential entry is preferably at a right angle to the quench tube 32 whereas any angle may be employed as long as the oil will fill the low-pressure zone 44 around the circumference of the quench tube 34 next to the face 43*c*. Similarly, the distance of the outside surface of nozzle 39 from face 43*c* is determined by the need to have the oil pulled and spread into the low-pressure zone 44 without overflowing the sharp edge 43*d*. In the preferred embodiment of the invention, this distance should lie between about 20% and 100% of the inside diameter of nozzle 39.

Insertion ring 43 may be fabricated as a ring that is welded inside quench tube 32, or it may be fabricated as an integral portion of the quench tube. Insertion ring 43, as illustrated in FIG. 4, includes a ramp portion 43*a* that is preferably about 71 or 72 degrees but may be inclined to 90 degrees, or more, maximum grade. The ramp, 43*a*, may be as little as zero degrees in the case of two separate quench tube diameters. The ramp portion 43*a* terminates in a flat or curved portion 43*b* which, in turn, terminates in a sharp edge, or interface 43*d*, with face 43*c*. Under gas flow conditions, the insertion ring 43 restricts the flow area causing the gas velocity to increase as it flows through the insertion ring. A low-pressure zone 44 is created by this increased velocity which tends to pull the tangentially injected wetting fluid from nozzle 39 into the low-pressure zone 44 thereby wetting the quench tube inner wall and insertion ring surface 43*c* in this area. The wetting fluid from nozzle 39 is then conveyed downstream by the furnace gas flow and is maintained against (thereby wetting) the quench tube 32 wall. The length of the ramp 43*a* is preferably as long as possible so as to cause the least turbulence; however, manufacturing (machining) limitations control the physical dimensions which are possible.

Although the orientation of the quench tube 32 is shown as being horizontal, as long as the combined momentum of the wetting fluid and gas flow can maintain the quench wall wetted, the orientation of the quench tube 32 can be vertical or at an angle to the horizontal position, upflow or downflow. The lines should be sized and oriented, and the gas and liquid flow rates should be such as to produce and maintain two-phase annular flow within the quench tube 32 downstream of face 43*c* in order to accomplish the wall wetting function.

A similar injection nozzle will be used for the secondary TLE.

What is claimed is:

1. A process for cracking liquid hydrocarbon feed to produce cracked gaseous hydrocarbons, the process comprising the steps of:

(a) feeding a liquid hydrocarbon feed stream to an olefins furnace;

(b) cracking the liquid hydrocarbon feed stream in the olefins furnace to produce a hot gaseous cracked effluent stream having a temperature of about 1400 to about 1650° F.;

(c) feeding the hot gaseous cracked effluent stream from the olefins furnace to the first section of a primary transfer line heat exchanger (TLE), which first section of said primary TLE comprises a shell-and-tube heat exchanger where the hot gaseous cracked effluent stream is indirectly cooled on the tube side while generating high-pressure steam from saturated steam on the shell side;

(d) feeding the gaseous cracked effluent exiting the first section of the primary TLE to the tube side of a second section of the primary TLE, where a flow obstruction means is positioned in said tube side of the second section to create a low-pressure zone in said gaseous cracked effluent stream immediately downstream of said flow obstruction means, and where the gaseous cracked effluent stream is indirectly cooled on the tube side while generating saturated steam from boiler feed water on the shell side;

(e) injecting a wetting fluid tangentially into said gaseous cracked effluent stream at said low-pressure zone at a momentum sufficient to cause said wetting fluid to flow circumferentially around the inside surface of said tube side; providing a sharp interface between said gaseous cracked effluent stream and said first wetting fluid; and causing said first wetting fluid to contact and wet the downstream face of said flow obstruction means;

(f) wherein the weight ratio of wetting fluid to the hot gaseous feed stream entering the tube side of a second section of the primary TLE is about 0.5 to about 2.0, the exit temperature of the gaseous effluent stream from the first section of said primary TLE is about 1100 to about 1200° F. and the exit temperature of the gaseous effluent stream from the second section of the primary TLE is approximately 50° F. above the temperature of the steam being generated;

(g) feeding the gaseous cracked effluent stream exiting from the second section of said primary TLE to a separator; and (h) separating in the separator, a separator bottoms stream comprising tar and heavier hydrocarbons and a separator product stream comprising an olefin product.

2. The process of claim 1, wherein said liquid hydrocarbon feed stream is selected from the group consisting of vacuum gas oil, heavy gas oil, heavy crude oil fractions, high end point condensates, deasphalted oil, oils derived from tar sands, oil shale, SMDS (Shell Middle Distillate Synthesis) heavy ends, GTL (Gas to Liquid) heavy ends, Heavy Paraffins Synthesis products, Fischer Tropsch products and hydrocrackate.

3. The process of claim 1, wherein said wetting fluid is injected at substantially a right angle to said hot gaseous effluent stream, and the weight ratio of wetting fluid to the hot gaseous feed stream entering the tube side of a second section of the primary TLE is about 0.5 to about 1.0.

4. The process of claim 1, wherein said wetting fluid is selected from the group consisting of pyrolysis liquid products, cracked light gas oil, cracked heavy gas oil and pitch.

5. The process of claim 1, wherein said separator product stream from step (h) is routed to a secondary TLE.

6. A process for cracking liquid hydrocarbon feed to produce cracked gaseous hydrocarbons, the process comprising the steps of:

(a) feeding a liquid hydrocarbon feed stream to an olefins furnace;

(b) cracking the liquid hydrocarbon feed stream in the olefins furnace to produce a hot gaseous cracked effluent stream having a temperature of about 1400 to about 1650° F.;

(c) feeding the hot gaseous cracked effluent stream from the olefins furnace to the first section of a primary transfer line heat exchanger (TLE), which first section of said primary TLE comprises a shell-and-tube heat exchanger where the hot gaseous cracked effluent stream is indirectly cooled on the tube side while generating high-pressure steam from saturated steam on the shell side;

(d) feeding the gaseous cracked effluent exiting the first section of the primary TLE to the tube side of a second section of the primary TLE, where a flow obstruction means is positioned in said tube side of the second section to create a low-pressure zone in said gaseous cracked effluent stream immediately downstream of said flow obstruction means, and where the gaseous cracked effluent stream is indirectly cooled on the tube side while generating saturated steam from boiler feed water on the shell side;

(e) injecting a first wetting fluid tangentially into said gaseous cracked effluent stream at said low-pressure zone at a momentum sufficient to cause said wetting fluid to flow circumferentially around the inside surface of said tube side; providing a sharp interface between said gaseous cracked effluent stream and said first wetting fluid; and causing said first wetting fluid to contact and wet the downstream face of said flow obstruction means; and wherein the weight ratio of wetting fluid to the hot gaseous feed stream entering the tube side of a second section of the primary TLE is about 0.5 to about 2.0 and wherein the exit temperature of said gaseous effluent stream from the first section of said primary TLE is between about 1100° F. and about 1200° F. and the exit temperature of the second section of the primary TLE is approximately 50° F. above the temperature of the saturated steam being generated;

(f) feeding the gaseous cracked effluent stream exiting from the second section of said primary TLE to a separator;

(g) removing in the separator, a separator bottoms liquid stream comprising tar and heavier hydrocarbons and a separator product gas stream comprising an olefin rich product;

(h) feeding the separator product gas stream exiting the separator to at least one secondary TLE where the separator product gas stream is indirectly cooled on the tube side to an exit temperature of between about 400 to about 500° F. while generating low-pressure steam on the shell side from boiler feed water and where a second flow obstruction means is positioned in said tube side of said secondary TLE to create a low-pressure zone in said product gas stream immediately downstream of said second flow obstruction means whereby a second wetting fluid is introduced at said low-pressure zone at sufficient flowrate to maintain the downstream internal surfaces in a wetted state;

(i) feeding the gaseous cracked effluent stream exiting from said second TLE to a second separator;

(j) removing from the second separator, a separator liquid bottoms stream comprising tar and heavier hydrocarbons and a separator product gas stream comprising an olefin rich product; and (k) recovering olefin product(s) from the separator product stream.

7. The process of claim 6, wherein said liquid hydrocarbon feed stream is selected from the group consisting of vacuum gas oil, heavy gas oil, heavy crude oil fractions and deasphalted oil.

8. The process of claim 6, wherein said first wetting fluid is injected at substantially a right angle to said hot cracked gaseous effluent stream in said primary TLE and said second wetting fluid is injected at substantially a right angle to said gaseous cracked effluent stream in said secondary TLE.

9. The process of claim 6 wherein said first wetting fluid is selected from the group consisting of pyrolysis liquid products: cracked light gas oil, cracked heavy gas oil and pitch, and said second wetting fluid is selected from the group consisting of cracked light gas oils and mixtures of cracked light gas oils and cracked heavy gas oils.

* * * * *